US005087050A

United States Patent [19]

Donovan

[11] Patent Number: 5,087,050

[45] Date of Patent: Feb. 11, 1992

[54] HISTORY GAME APPARATUS UTILIZING FIBER OPTIC CABLE SEGMENTS

[76] Inventor: Thomas D. Donovan, 3637 Morrell Cir., Philadelphia, Pa. 19114

[21] Appl. No.: 694,684

[22] Filed: May 2, 1991

[51] Int. Cl.[5] ..... A63F 3/04; A63F 9/18

[52] U.S. Cl. ..... 273/237; 273/252; 273/DIG. 24; 273/431

[58] Field of Search ..... 273/237, 243, 249-254, 273/271

[56] References Cited

U.S. PATENT DOCUMENTS

| | | | |
|---|---|---|---|
| 4,273,337 | 6/1981 | Carrera | 273/243 |
| 4,706,960 | 11/1987 | Nowacki et al. | 273/257 |
| 4,807,878 | 2/1989 | Tripp | 273/237 |
| 4,958,837 | 9/1990 | Russell | 273/237 |

FOREIGN PATENT DOCUMENTS

| | | | |
|---|---|---|---|
| 396266 | 11/1990 | European Pat. Off. | 273/237 |

*Primary Examiner*—Benjamin Layno
*Attorney, Agent, or Firm*—Leon Gilden

[57] ABSTRACT

A game apparatus for educating players in history. The game includes six decks of question and answer cards. Each card deck is color coded to correspond to one of six different categories related to the history of the black race. The card decks correspond to a spinner member having spaces also color coded for directing players to attempt to answer question from the decks of cards. The board game further includes a game board having a map of the world and a plurality of migratory paths all starting from the African continent. Each migratory path is formed of a fiber optic cable divided into a plurality of fiber optic cable segments removably mounted within grooves in the game board. Each player is assigned a migratory path and upon correct response to question, the player positions a fiber optic cable segment in the groove of his assigned path.

2 Claims, 5 Drawing Sheets

HISTORY GAME APPARATUS UTILIZING FIBER OPTIC CABLE SEGMENTS

BACKGROUND OF THE INVENTION

1. Field of the Invention

The field of invention relates to game apparatus, and more particularly pertains to a new and improved history game apparatus wherein the same is directed to the acknowledgment, understanding, and education relative to the historical contributions and migratory history of the black race directed from the African Continent of reference outwardly therefrom.

2. Description of the Prior Art

Various game apparatus is set forth utilizing cards and the like for directing response to questions relative to the cards. Such apparatus is exemplified in U.S. Pat. No. 4,893,819 to Wright wherein a personality-type board game is provided, wherein a response to questions is required for advancement.

U.S. Pat. No. 4,877,254 to Yuscavage sets forth a board game wherein random chance requires response to general categories of information and alphabet answer cards.

U.S. Pat. No. 4,807,878 to Tripp sets forth a trivia game requiring proper response to predetermined questions.

U.S. Pat. No. 4,736,954 to Haney, et al. sets forth a question and answer game relative to geographical questions.

As such, it may be appreciated that there continues to be a need for a new and improved history game apparatus as set forth by the instant invention which addresses both the problems of ease of use as well as effectiveness in construction in directing understanding of a particular race relative to their migratory and history and in this respect, the present invention substantially fulfills this need.

SUMMARY OF THE INVENTION

In view of the foregoing disadvantages inherent in the known types of game apparatus now present in the prior art, the present invention provides a history game apparatus wherein the same is directed to effect amusement and entertainment of individuals in the understanding of migratory and historical developments of individuals in a geographical and historical setting. As such, the general purpose of the present invention, which will be described subsequently in greater detail, is to provide a new and improved history game apparatus which has all the advantages of the prior art game apparatus and none of the disadvantages.

To attain this, the present invention provides a game apparatus setting forth entertainment and education and providing understanding of historical progression of individuals originating from a predetermined geographic origin to remote geographic orientations relative thereto. The organization includes a plurality of decks of cards, each deck defining a predetermined contribution relative to the individuals, whereupon each card is of a contrasting coloration or coding cooperating with a spinner member, wherein the spinner includes a plurality of spinner spaces associated with respective codings directing sequential players to attempt to answer questions of the decks of cards. A modification of the invention includes the migratory paths of the individuals directed from a source of origin and formed of fiber optic cables, wherein the fiber optic cables are each formed of segments, whereupon correct response to a question permits filling in of a segment, whereupon completion of migratory paths from the origin to one of the remote geographical orientations provides bonus points for a player.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved history game apparatus which has all the advantages of the prior art game apparatus and none of the disadvantages.

It is another object of the present invention to provide a new and improved history game apparatus which may be easily and efficiently manufactured and marketed.

It is a further object of the present invention to provide a new and improved history game apparatus which is of a durable and reliable construction.

An even further object of the present invention is to provide a new and improved history game apparatus which is susceptible of a low cost of manufacture with regard to both materials and labor, and which accordingly is then susceptible of low prices of sale to the consuming public, thereby making such history game apparatus economically available to the buying public.

Still yet another object of the present invention is to provide a new and improved history game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
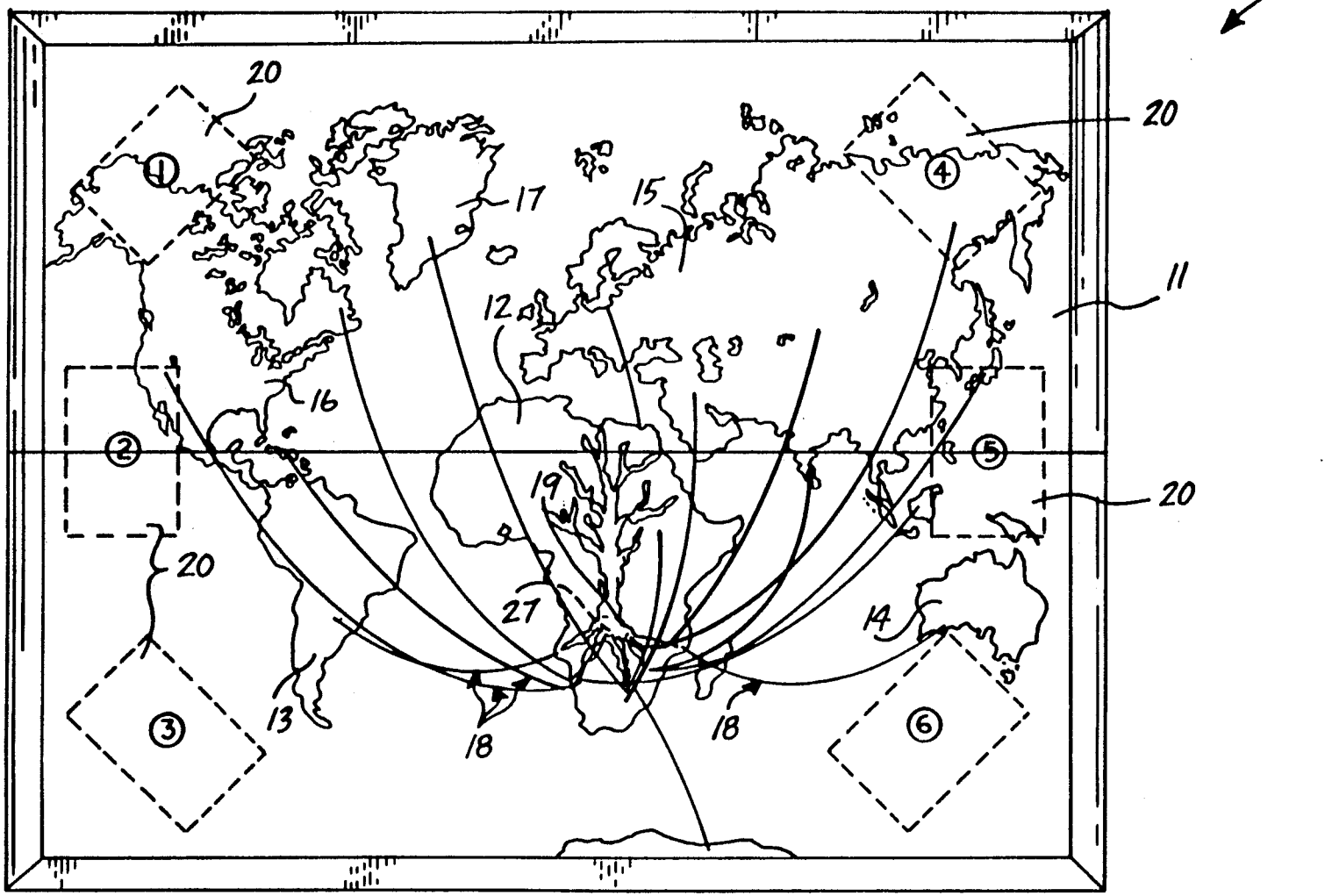
FIG. 1 is an orthographic view of the game board of the instant invention.
Figure 2:
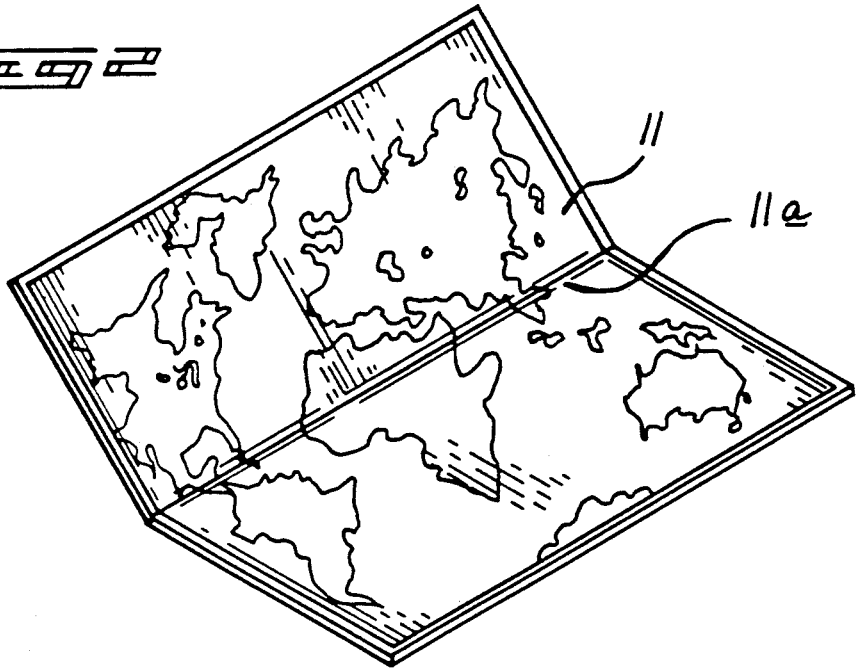
FIG. 2 is an isometric illustration of the game board in a partially folded configuration.

With reference now to the drawings, and in particular to FIGS. 1 to 12 thereof, a new and improved history game apparatus embodying the principles and concepts of the present invention and generally designated by the reference numeral 10 will be described.

Figure 3:
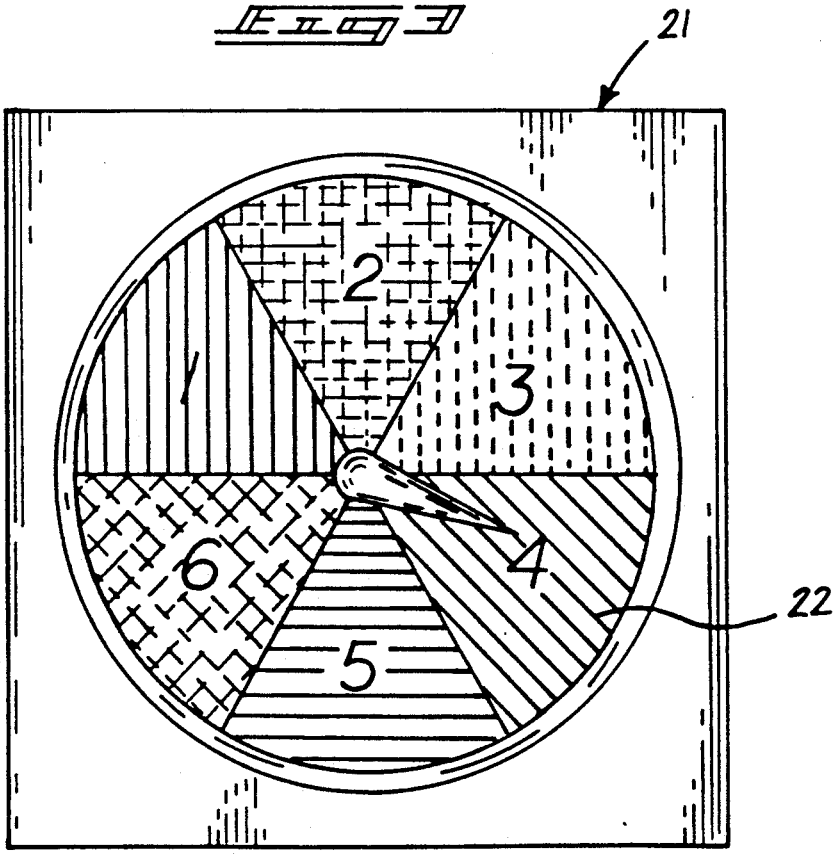
FIG. 3 is a top orthographic view of a spinner utilized by the instant invention.
Figure 4:
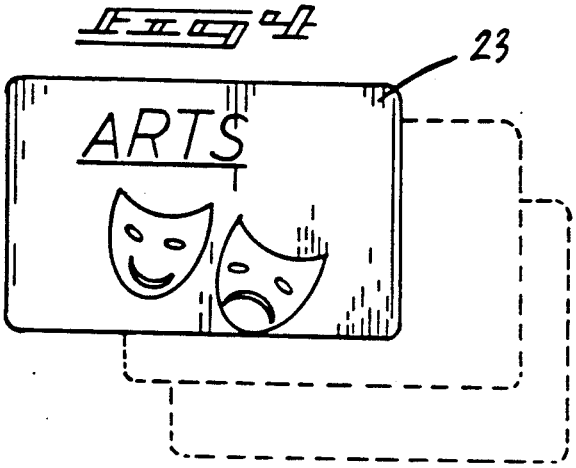
FIGS. 4–9 are top orthographic views of the categories of card decks utilized by the instant invention.
Figure 5:
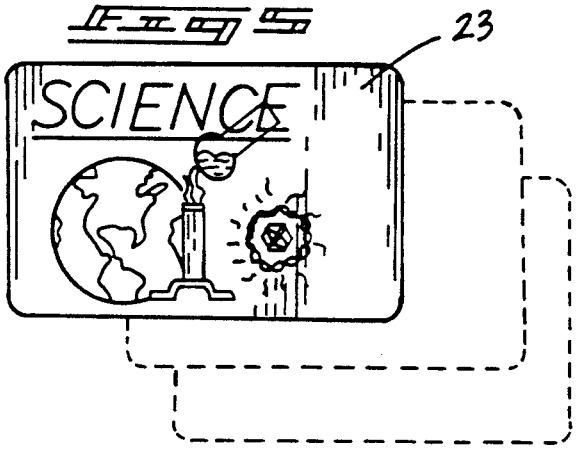
Figure 6:
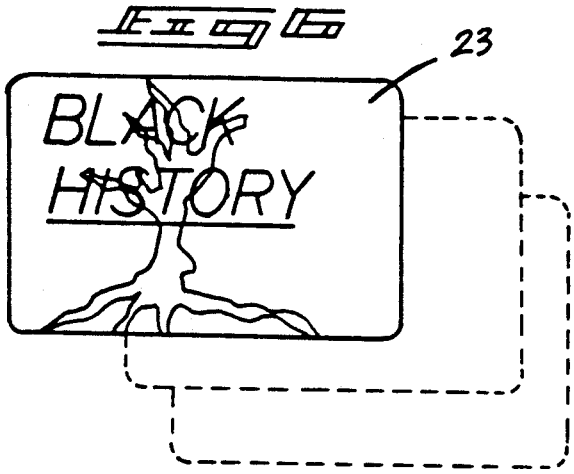
Figure 7:
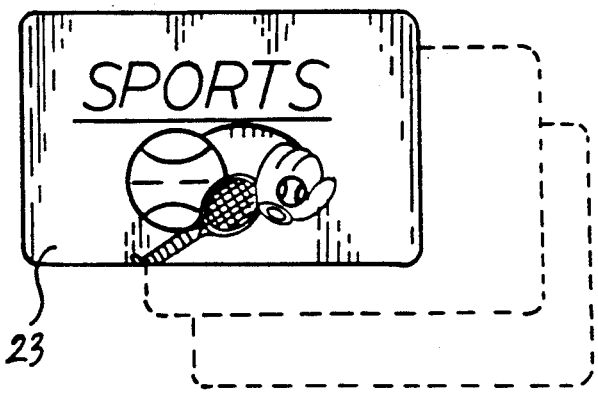
Figure 8:
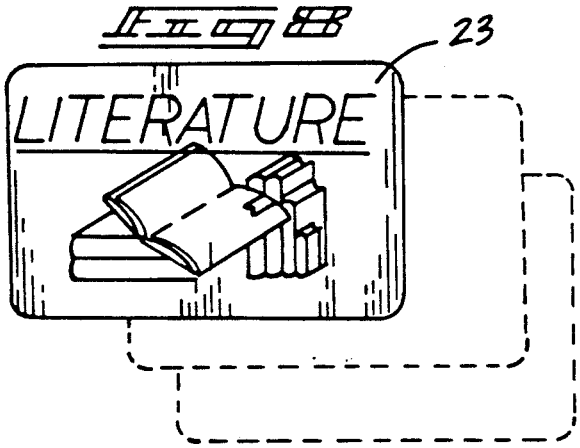
Figure 9:
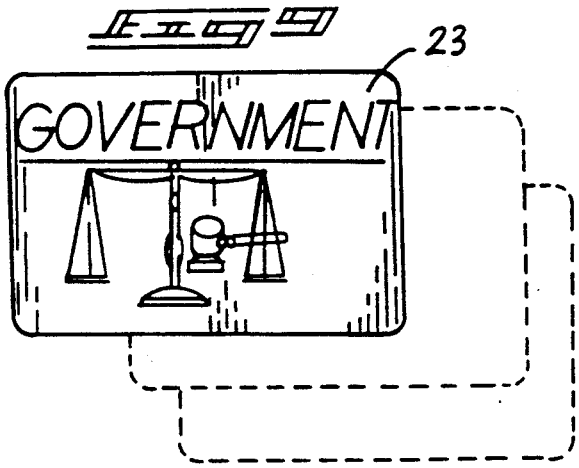

More specifically, the history game apparatus 10 of the instant invention essentially comprises a game board 11 that may be interfolded about a central hinge 11*a*. The game board 11 is formed with a centrally located simulation of the African Continent 12, with various simulated target designation geographic points defined by respective first, second, third, fourth, and fifth target designations 13, 14, 15, 16, and 17. The simulations include the North American Continent, the Australian Continent, the European Continent, South American Continent, Greenland, and the like. To these various target designations are directed migratory paths 18. Each of the migratory paths 18 originates at a central origin base 19 positioned within the continent 12. The game board 11 further includes a predetermined number of card deck spaces 20 directed about the perimeter of the game board, with each of the card deck spaces including a respective deck of cards from the predetermined number of card decks 23. Each of the card decks includes a historical background to include for example "arts", "science", "black history", "sports", "literature", and "government". A spinner assembly, as illustrated in FIG. 3, is provided, with the spinner assembly 21 including the predetermined number of target zones 22. Each target zone is coated, either by coloration or enumeration, with a respective card deck of the predetermined number of card decks 23, with each card deck positioned upon a predetermined card deck space 20 of the predetermined number of card deck spaces, whereupon sequential players in turn respond to a question from the decks of cards that are directed by the spinning of the spinner of the spinner assembly 21 directing such questions. Each player is accordingly awarded a point total for a correct response, wherein a greatest point total is declared a winner.

Figure 10:
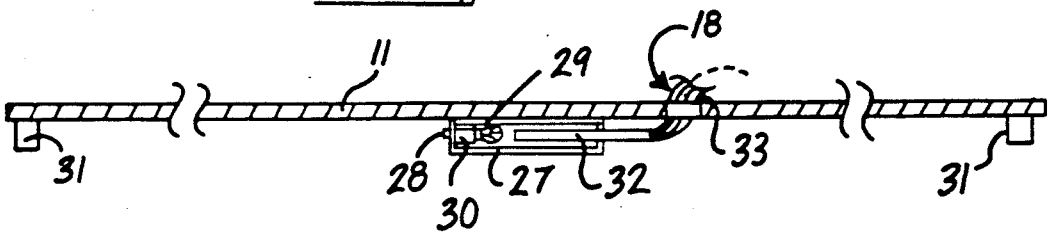
FIG. 10 is an orthographic cross-sectional illustration of the invention utilizing a fiber optic cable housing positioned below the game board.
Figure 11:
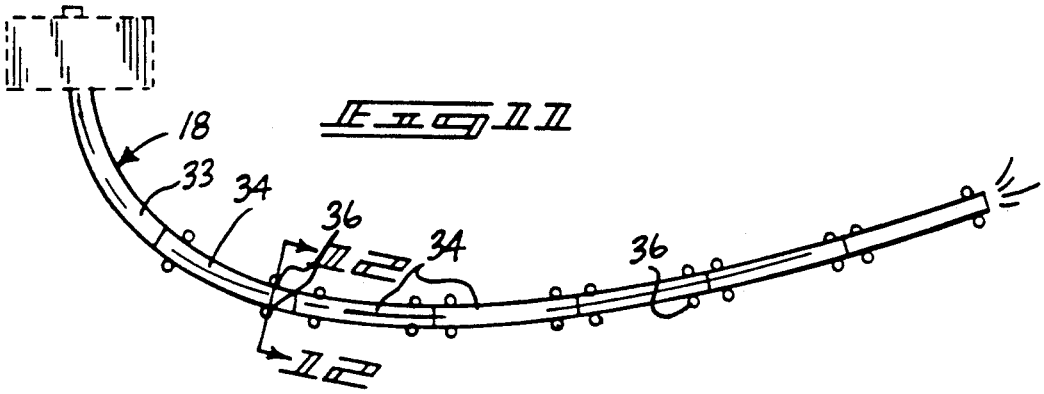
FIG. 11 is a top orthographic view of the fiber optic cable housing and the segmented fiber optic cable characteristic of each migratory path of travel utilized by the instant invention.
Figure 12:
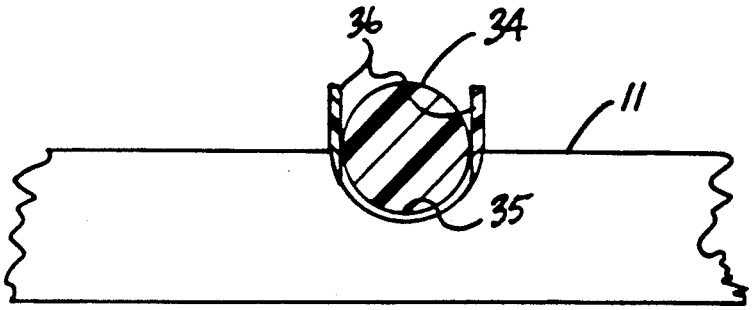
FIG. 12 is an orthographic view, taken along the lines 12—12 of FIG. 11 in the direction indicated by the arrows.

In the supplemental construction of the invention, as illustrated in FIGS. 10, 11, and 12, the migratory paths 18 are formed of fiber optic cables of fiber optic cable segments 34, as illustrated in FIG. 11. A fiber optic cable housing 27 is positioned below the central origin base 19 to a bottom surface of the game board 11. The game board 11 includes a plurality of table support legs 31 to space the housing and the legs at an equal predetermined level, whereupon the housing is defined by a predetermined thickness equal to a predetermined thickness o each of the legs 31. A fiber optic cable sheath 32 is directed into the housing 27, wherein a switch 28 effects selective illumination of illumination bulb 29 mounted within an illumination bulb socket and battery 30. The fiber optic cable segments include a base cable 33 fixedly mounted to a top surface of the game board 11 adjacent the central origin base 19 from the fiber optic cable housing 27. Each of the fiber optic cable game migratory paths 18 is formed of the segments 34, wherein the segments 34 are mounted within a single groove 35, with plural pairs of pegs mounted on opposed sides of the groove to maintain each of the segments within the groove. Upon correct response of a question, an individual positions a fiber optic cable segment 34 in abutment with a preceding face, wherein the planar faces permit projection of illumination to the fiber optic cable, whereupon final completion of a migratory path 18 of the fiber optic cable segments 34 provides a bonus number of points to a player, whereupon a player initiating construction of a fiber optic cable migratory path 18 is given bonus points for positioning a segment of the plurality of segments 34 within each individual path 18, and given exclusive right to complete any path that that player has begun.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A history game apparatus, comprising in combination, a game board, the game board including a geographic continent designation, with the geographic continent designation including an origin base therewithin, and the game board further including a plurality of further geographical designations in surrounding relationship relative to the central origin base, and at least one migratory path directed from the central origin base to each further geographical designation, and each of the migratory paths merging at the central origin base, and a predetermined number of card deck spaces positioned on the game board in surrounding relationship relative to the origin base, and a predetermined number of card decks, each of the card decks formed of a plurality of cards, with each of the plurality of cards including questions relating to distinct historical data, with a card deck of the plurality of card decks mounted on each of said predetermined number of card deck spaces, and each of the card deck spaces, and each of the card decks including a coated designation, and a spinner assembly, the spinner assembly including a plurality of spinner target spaces positioned in relation to the spinner assembly, wherein each of the spinner target spaces designates a coated card deck of the plurality of card decks, and said game board includes a fiber optic cable housing mounted to a bottom surface of the game board below the origin base, and the fiber optic cable housing defined by a predetermined height, and including a plurality of table support legs mounted to the bottom surface of the game board, wherein each leg is defined by the predetermined height, and each of the migratory paths is defined by a fiber optic cable, and each fiber optic cable merging into a fiber optic cable sheath, wherein the fiber optic cable sheath is directed through the game board into the fiber optic cable housing, the fiber optic cable housing including an illumination bulb and switch means for effecting selective illumination of the illumination bulb to direct illumination through each fiber optic cable, and each fiber optic cable includes a plurality of fiber optic cable segments removably mounted relative to the game board.

2. An apparatus as set forth in claim 1 wherein each of the fiber optic cables is mounted within a continuous groove, and each fiber optic cable segment includes a plurality of peg pairs, wherein each peg of the peg pairs is orthogonally mounted to a top surface of the game board adjacent the groove to maintain each of the fiber optic cable segments within the groove.

* * * * *